US010923025B2

(12) United States Patent
Gai et al.

(10) Patent No.: US 10,923,025 B2
(45) Date of Patent: Feb. 16, 2021

(54) PIXEL COMPENSATION CIRCUIT, METHOD FOR COMPENSATING PIXEL DRIVING CIRCUIT, AND DISPLAY DEVICE

(71) Applicant: BOE TECHNOLOGY GROUP CO., LTD., Beijing (CN)

(72) Inventors: Cuili Gai, Beijing (CN); Yicheng Lin, Beijing (CN); Ling Wang, Beijing (CN); Pan Xu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/346,519

(22) PCT Filed: Nov. 12, 2018

(86) PCT No.: PCT/CN2018/115016
§ 371 (c)(1),
(2) Date: Apr. 30, 2019

(87) PCT Pub. No.: WO2019/196402
PCT Pub. Date: Oct. 17, 2019

(65) Prior Publication Data

US 2019/0318684 A1 Oct. 17, 2019

(30) Foreign Application Priority Data

Apr. 11, 2018 (CN) ..... 2018 1 0321443

(51) Int. Cl.
*G09G 3/32* (2016.01)

(52) U.S. Cl.
CPC ..... *G09G 3/32* (2013.01); *G09G 2320/0233* (2013.01); *G09G 2360/145* (2013.01)

(58) Field of Classification Search
CPC ..... G09G 3/3233; G09G 2300/043; G09G 2320/0233; G09G 3/3258;
(Continued)

(56) References Cited

U.S. PATENT DOCUMENTS 8,589,100 B2 11/2013 Chaji et al.
9,214,107 B2 12/2015 Fish et al.
(Continued)

FOREIGN PATENT DOCUMENTS

CN 1846243 10/2006
CN 105225621 1/2016
(Continued)

OTHER PUBLICATIONS

International Search Report and Written Opinion for PCT Application PCT/CN2018/115016 dated Jan. 30, 2019.

*Primary Examiner* — Kent W Chang
*Assistant Examiner* — Scott D Au
(74) *Attorney, Agent, or Firm* — Thomas | Horstemeyer LLP

(57) ABSTRACT

A method for compensating the pixel driving circuit may include: in a light emitting phase of the pixel driving circuit, sensing an electric signal of the first electrode of the electroluminescent element, and calculating an electrical compensation signal based on the electric signal; in the light emitting phase of the pixel driving circuit, sensing a brightness signal of the electroluminescent element by a photosensitive sensor and calculating an optical compensation signal according to the brightness signal; and generating a comprehensive compensation signal according to the electrical compensation signal and the optical compensation signal, and controlling a signal on a control terminal of the drive transistor according to the comprehensive compensation signal.

20 Claims, 3 Drawing Sheets

(58) Field of Classification Search
CPC ..... G09G 2320/045; G09G 3/32; G09G 2310/0243; G09G 2360/145; G09G 2310/0264; G09G 2360/14
See application file for complete search history.

(56) References Cited

U.S. PATENT DOCUMENTS

| | | | | |
|---|---|---|---|---|
| 9,430,958 | B2 | 8/2016 | Chaji et al. | |
| 9,773,441 | B2 | 9/2017 | Chaji et al. | |
| 9,881,532 | B2 | 1/2018 | Chaji | |
| 9,972,246 | B2 | 5/2018 | Park et al. | |
| 10,032,399 | B2 | 7/2018 | Chaji et al. | |
| 2006/0256048 | A1 | 11/2006 | Fish et al. | |
| 2011/0191042 | A1 | 8/2011 | Chaji et al. | |
| 2012/0074298 | A1* | 3/2012 | Miyazawa | H01L 27/1461 250/208.1 |
| 2014/0015824 | A1 | 1/2014 | Chaji et al. | |
| 2014/0152633 | A1* | 6/2014 | Park | G09G 3/3291 345/207 |
| 2014/0292342 | A1 | 10/2014 | Chaji | |
| 2014/0306868 | A1 | 10/2014 | Chaji | |
| 2014/0313111 | A1 | 10/2014 | Chaji et al. | |
| 2015/0243217 | A1 | 8/2015 | Park et al. | |
| 2016/0307498 | A1* | 10/2016 | Chaji | G09G 3/3291 |
| 2017/0011674 | A1 | 1/2017 | Chaji et al. | |
| 2017/0365201 | A1 | 12/2017 | Chaji et al. | |
| 2018/0137795 | A1 | 5/2018 | Chaji | |
| 2018/0158402 | A1 | 6/2018 | Chaji et al. | |

FOREIGN PATENT DOCUMENTS

| | | |
|---|---|---|
| CN | 107622754 | 1/2018 |
| CN | 108492765 | 9/2018 |
| EP | 2531996 | 12/2012 |
| EP | 3324391 | 5/2018 |
| WO | 2005022498 | 3/2005 |
| WO | 2011095954 | 8/2011 |

* cited by examiner

PIXEL COMPENSATION CIRCUIT, METHOD FOR COMPENSATING PIXEL DRIVING CIRCUIT, AND DISPLAY DEVICE

CROSS REFERENCE TO RELATED APPLICATION

This application is a § 371 national phase application of PCT/CN2018/115016 filed Nov. 12, 2018, which claims the benefit of and priority to Chinese Patent Application No. 201810321443.9 filed on Apr. 11, 2018, the entire contents of which being incorporated herein by reference as a part of the present application.

TECHNICAL FIELD

The present disclosure relates to the field of display technologies, and more particularly, to a pixel compensation circuit, a method for compensating a pixel driving circuit, and a display device.

BACKGROUND

In a pixel driving circuit, the instability of the manufacturing process causes differences in the threshold voltage, and the mobility of drive transistors, and the drive voltage of electroluminescent elements, and the like among a plurality of pixels, and thus causes differences in the drive current of the electroluminescent elements, thereby causing inconsistent light emission brightness of the electroluminescent element in each pixel unit. Thus, this causes a decrease in brightness uniformity of a display screen, and even generates residual images such as regional spots and regional images, etc.

To solve the above problems, it is necessary to compensate a pixel circuit to improve the display effect of a display device.

It is to be noted that the above information disclosed in this Background section is only for enhancement of understanding of the background of the present disclosure and therefore it may contain information that does not form the prior art that is already known to a person of ordinary skill in the art.

SUMMARY

An objective of the present disclosure is to provide a pixel compensation circuit, a method for compensating pixel driving circuit, and a display device.

According to an aspect of the present disclosure, there is provided a method for compensating a pixel driving circuit. The pixel driving circuit includes a drive transistor connected to a first electrode of an electroluminescent element, and the method for compensating a pixel driving circuit includes:

in a light emitting phase of the pixel driving circuit, sensing an electric signal of the first electrode of the electroluminescent element, and calculating an electrical compensation signal based on the electric signal;

in the light emitting phase of the pixel driving circuit, sensing a brightness signal of the electroluminescent element by a photosensitive sensor, and calculating an optical compensation signal according to the brightness signal; and generating a comprehensive compensation signal according to the electrical compensation signal and the optical compensation signal, and controlling a signal on a control terminal of the drive transistor according to the comprehensive compensation signal.

In an exemplary embodiment of the present disclosure, the sensing an electric signal of the first electrode of the electroluminescent element includes:

sensing a current signal flowing through the electroluminescent element to acquire the electric signal of the first electrode of the electroluminescent element.

In an exemplary embodiment of the present disclosure, the sensing an electric signal of the first electrode of the electroluminescent element includes:

sensing a current signal flowing through the drive transistor to acquire the electric signal of the first electrode of the electroluminescent element.

According to an aspect of the present disclosure, there is provided a pixel compensation circuit, which is configured to provide a comprehensive compensation signal to a pixel driving circuit. The pixel driving circuit includes a drive transistor connected to a first electrode of an electroluminescent element, and the pixel compensation circuit includes:

an external electrical compensation sub-circuit configured to sense, in a light emitting phase of the pixel driving circuit, an electric signal of the first electrode of the electroluminescent element;

an external optical compensation sub-circuit configured to sense, in the light emitting phase of the pixel driving circuit, a brightness signal of the electroluminescent element by a photosensitive sensor; and a processor configured to calculate an electrical compensation signal according to the electric signal, calculate an optical compensation signal according to the brightness signal, generate a compensative compensation signal according to the electrical compensation signal and the optical compensation signal, and control a signal on a control terminal of the drive transistor according to the comprehensive compensation signal.

In an example embodiment of the present disclosure, sensing an electric signal of the first electrode of the electroluminescent element includes:

sensing a current signal flowing through the electroluminescent element to acquire the electric signal of the first electrode of the electroluminescent element; or sensing a current signal flowing through the drive transistor to acquire the electric signal of the first electrode of the electroluminescent element.

In an example embodiment of the present disclosure, the external electrical compensation sub-circuit includes a first switch element and a sense line.

The first switch element is connected to the first electrode of the electroluminescent element and is configured to be enabled in response to a scanning signal to communicate the first electrode of the electroluminescent element with the sense line.

The sense line is connected to the first switch element and is configured to sense, by the first switch element, an electric signal of the first electrode of the electroluminescent element, and transmit the electric signal to the processor.

In an example embodiment of the present disclosure, the first switch element includes a first terminal, a second terminal, and a control terminal.

The control terminal receives the scanning signal, the first terminal is connected to the first electrode of the electroluminescent element, and the second terminal is connected to the sense line.

In an example embodiment of the present disclosure, the external optical compensation sub-circuit includes the photosensitive sensor and a second switch element.

The photosensitive sensor is configured to sense, in the light emitting phase of the pixel driving circuit, a brightness signal of the electroluminescent element.

The second switch element is connected between the sense line and the photosensitive sensor, and is configured to be enabled in response to a scanning signal, such that the brightness signal sensed by the photosensitive sensor is transmitted to the processor through the sense line.

In an exemplary embodiment of the present disclosure, the second switch element includes a control terminal, a first terminal, and a second terminal.

The control terminal receives the scanning signal, the first terminal is connected to the sense line, and the second terminal is connected to the photosensitive sensor.

According to an aspect of the present disclosure, a display device is provided which includes the pixel compensation circuit according to any one of the above embodiments.

In an exemplary embodiment of the present disclosure, the pixel compensation circuit includes an external electrical compensation sub-circuit and an external optical compensation sub-circuit.

The external electrical compensation sub-circuit is arranged on a substrate of the display device.

The external optical compensation sub-circuit is arranged on a cover plate of the display device, and a photosensitive sensor in the external optical compensation sub-circuit directly faces an electroluminescent element in the display device.

In an example embodiment of the present disclosure, the processor is integrated into a drive integrated circuit of the display device.

It is understood that the above general description and the detailed description below are merely examples and explanatory, and do not limit the present disclosure.

This section provides a general summary of various implementations or examples of the technology described in the present disclosure, and is not a comprehensive disclosure of its full scope or all of its features.

BRIEF DESCRIPTION OF THE DRAWINGS

The above and other features and advantages of the present disclosure will become more apparent by describing in detail the exemplary embodiments thereof with reference to the accompanying drawings. Understandably, the accompanying drawings in the following description show merely some embodiments of the present disclosure, and persons of ordinary skill in the art may derive other drawings from these accompanying drawings without creative efforts. In the drawings.

DETAILED DESCRIPTION

Figure 1:
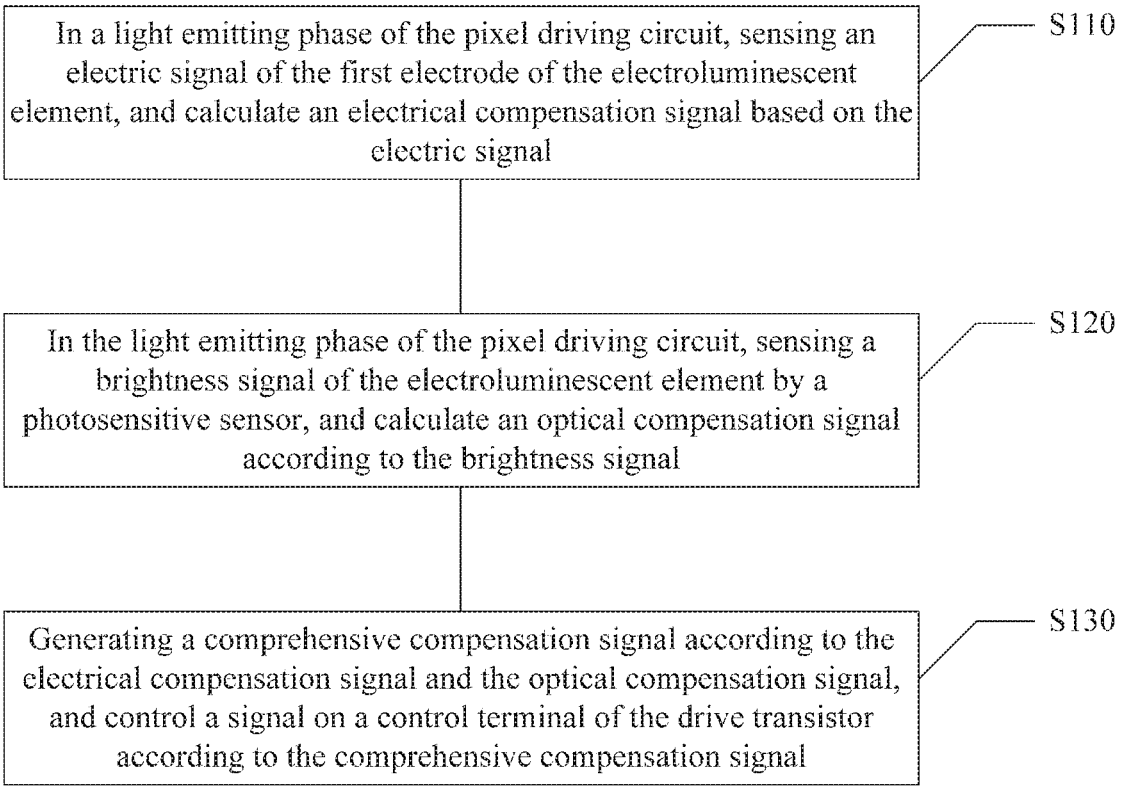
FIG. 1 is a flowchart of a method for compensating a pixel driving circuit according to the present disclosure.

The example embodiment will now be described more fully with reference to the accompanying drawings. However, the example embodiments can be implemented in a variety of forms and should not be construed as limited to the embodiments set forth herein. Rather, the embodiments are provided so that this disclosure will be thorough and complete and will fully convey the concepts of example embodiments to those skilled in the art. The features, structures, or characteristics described may be combined in one or more embodiments in any suitable manner. In the following description, numerous specific details are provided to give a full understanding of the embodiments of the present disclosure. However, those skilled in the art will appreciate that one or more of the specific details may be practiced without practicing the technical solutions of the present disclosure, and other methods, components, materials, devices, steps, and the like may be employed. In other instances, well-known technical solutions are not shown or described in detail to avoid obscuring aspects of the present disclosure.

In addition, the accompanying drawings are merely example illustrations of the present disclosure, and are not necessarily drawn to scale. The same reference numerals in the drawings denote the same or similar parts, and thus any repeated description thereof will be omitted.

This example embodiment provides a method for compensating a pixel driving circuit, wherein the pixel driving circuit includes a drive transistor connected to a first electrode of an electroluminescent element, and the drive transistor may be an N-type transistor or a P-type transistor. As shown in FIG. 1, the method for compensating a pixel driving circuit may include:

Step S110: in a light emitting phase of the pixel driving circuit, sensing an electric signal of the first electrode of the electroluminescent element, and calculating an electrical compensation signal based on the electric signal;

Step S120: in the light emitting phase of the pixel driving circuit, sensing a brightness signal of the electroluminescent element by a photosensitive sensor, and calculating an optical compensation signal according to the brightness signal; and Step S130: generating a comprehensive compensation signal according to the electrical compensation signal and the optical compensation signal, and controlling a signal on a control terminal of the drive transistor according to the comprehensive compensation signal.

According to the method for compensating a pixel driving circuit provided in an example embodiment of the present disclosure, in one aspect, a brightness signal of an electroluminescent element is sensed by a photosensitive sensor, i.e., a brightness value of the electroluminescent element is converted into the brightness signal by the photosensitive sensor to compensate the electroluminescent element according to the brightness signal. Compared with the related art, a new external optical compensation method is provided, which is large in compensation range, high in compensation precision, and fast in drive speed, and may compensate the electroluminescent element in real time. In another aspect, an electric signal of a first electrode of the electroluminescent element and a brightness signal of the electroluminescent element are sensed, and then the electroluminescent element is compensated according to the electric signal and the brightness signal, i.e., the electroluminescent element is compensated in combination with external electrical compensation and external optical compensation. The method is large in compensation range, high in compensation precision, and fast in drive speed, and may compensate the electroluminescent element in real time. In this regard, display unevenness caused by differences in the threshold voltage and the mobility of a drive transistor and the drive voltage of the electroluminescent element and the like may be compensated, the uniformity of the display brightness of each pixel is ensured, and the occurrence of residual images such as regional spots or regional images is avoided.

Figure 2:
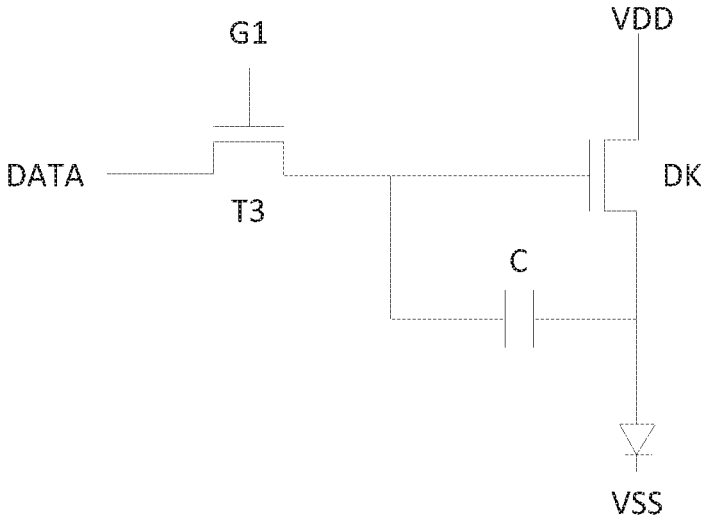
FIG. 2 is schematic diagram of a pixel driving circuit having a 2T1C structure according to an exemplary embodiment of the present disclosure.

FIG. 2 is a schematic diagram of a pixel driving circuit having a 2T1C structure corresponding to the method for compensating a pixel driving circuit. The pixel driving circuit having the 2T1C structure may include: a drive transistor DK connected to a first electrode of an electroluminescent element, a capacitor C, and a third switch element T3. A control terminal of the drive transistor DK is connected to a data line DATA through the third switch element T3. A first terminal of the drive transistor DK receives a first power signal VDD, a second terminal of the drive transistor DK is connected to the first electrode of the electroluminescent element, and a second electrode of the electroluminescent element receives a second power signal VSS. A control terminal of the third switch element T3 receives a first scanning signal G1. The capacitor C is connected between the control terminal and the second terminal of the drive transistor DK. The data line DATA is configured to provide a data signal to the control terminal of the drive transistor DK. The first electrode of the electroluminescent element may be an anode, and the second electrode of the electroluminescent element may be a cathode. Alternatively, the first electrode of the electroluminescent element may be the cathode, and the second electrode of the electroluminescent element may be the anode.

It is to be noted that, in the pixel driving circuit having the 2T1C structure as shown in FIG. 2, the third switch element T3 may be a P-type transistor or an N-type transistor, and all the transistors may be enhancement-type transistors or depletion type transistors, which is not particularly limited herein. The control terminal of the third switch element T3 may be a gate, the first terminal thereof may be a source, and the second terminal thereof may be a drain. Alternatively, the control terminal of the third switch element T3 may be a gate, the first terminal thereof may be a drain, and the second terminal thereof may be a source. In addition, the pixel driving circuit having the 2T1C structure as shown in FIG. 2 is one of a plurality of pixel driving circuits corresponding to the method for compensating a pixel driving circuit, which is an example and explanatory only and is not intended to limit the present disclosure.

The method for compensating a pixel driving circuit as shown in FIG. 1 is described below by taking an example in which the third switch element T3 in the pixel driving circuit having the 2T1C structure, as shown in FIG. 2, is an N-type transistor.

In Step S110, in the light emitting phase of the pixel driving circuit, an electric signal of the first electrode of the electroluminescent element is sensed, and an electrical compensation signal is calculated based on the electric signal.

Figure 3:
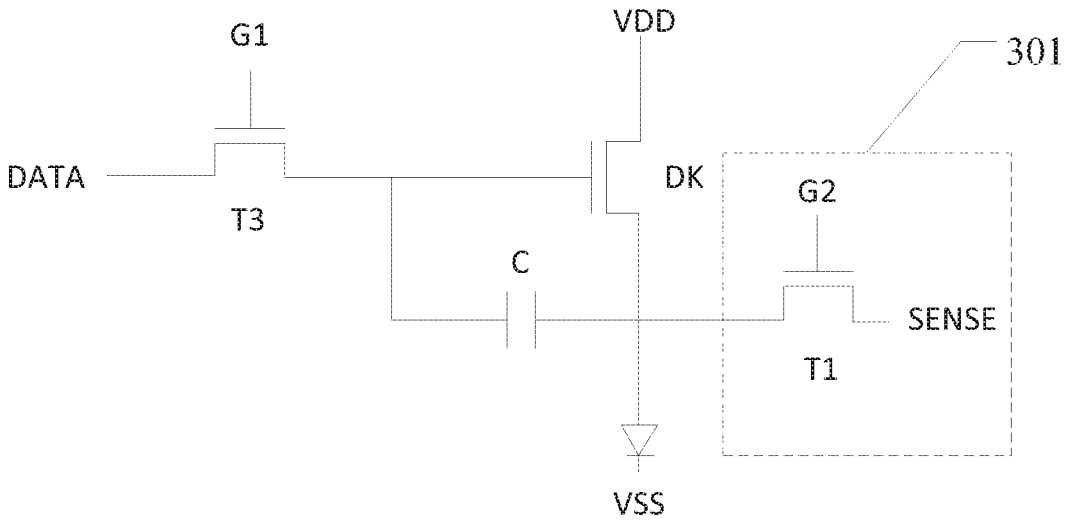
FIG. 3 is a schematic diagram of an external electrical compensation sub-circuit added on the basis of FIG. 2 according to an exemplary embodiment of the present disclosure.

In this example embodiment, an external electrical compensation sub-circuit may be added at the second end (i.e., the first electrode of the electroluminescent element) of the drive transistor DK in FIG. 2 to sense the electric signal of the first electrode of the electroluminescent element. FIG. 3 illustrates a schematic diagram of a circuit structure after the external electrical compensation sub-circuit 301 is added in FIG. 2. The external electrical compensation sub-circuit 301 may include a first switch element T1 and a sense line SENSE. Specifically, a control terminal of the first switch element T1 receives a scanning signal G2, a first terminal of the first switch element T1 is connected to a first electrode of the electroluminescent element, and a second terminal of the first switch element T1 is connected to the sense line SENSE. The first switch element T1 may be an N-type transistor or a P-type transistor, which is not particularly limited by this exemplary embodiment. Here, an example is taken where the first switch element T1 is an N-type transistor.

It is to be noted that the control terminal of the first switch element T1 may be a gate, the first terminal thereof may be a source, and the second terminal thereof may be a drain. Alternatively, the control terminal of the first switch element T1 may be a gate, the first terminal thereof may be a drain, and the second terminal thereof may be a source.

In a charging phase of the pixel driving circuit, a first scanning signal G1 is a high level, a scanning signal G2 is a low level, a third switch element T3 is enabled, the first switch element T1 is disabled, and a data signal on the data line DATA is transmitted to the control terminal of the drive transistor DK to charge the capacitor C. In a light emitting phase of the pixel driving circuit, the first scanning signal G1 is a low level, the scanning signal G2 is a high level, the third switch element T3 is disabled, the first switch element T1 is enabled, the control terminal of the drive transistor DK is enabled under the action of the capacitor C, and a drive current is output under the action of a first power signal VDD. Meanwhile, the sense line SENSE senses, by the first switch element T1, an electric signal of the first electrode of the electroluminescent element, and the electric signal is transmitted to a processor, such that the processor calculates an electrical compensation signal according to the electric signal.

Specifically, the sensing an electric signal of the first electrode of the electroluminescent element includes two manners as below.

Figure 4:
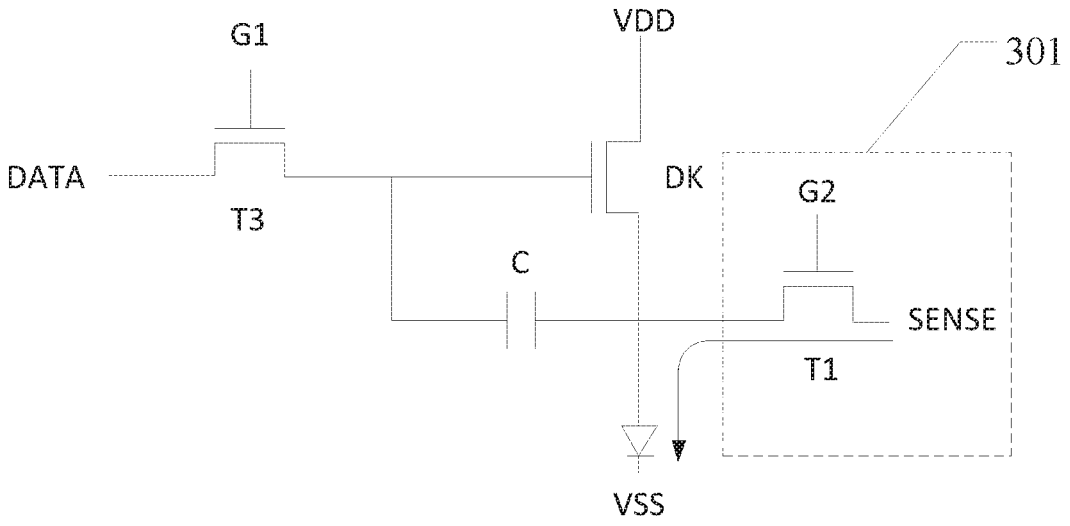
FIG. 4 is a schematic diagram of sensing a current signal flowing through an electroluminescent element according to an exemplary embodiment of the present disclosure.

In the Manner I, as shown in FIG. 4, a current signal flowing through the electroluminescent element may be sensed to acquire the electric signal of the first electrode of the electroluminescent element. In this exemplary embodiment, the current signal flowing through the electroluminescent element may be sensed, and the electric signal of the first electrode of the electroluminescent element may be calculated based on the current signal.

Figure 5:
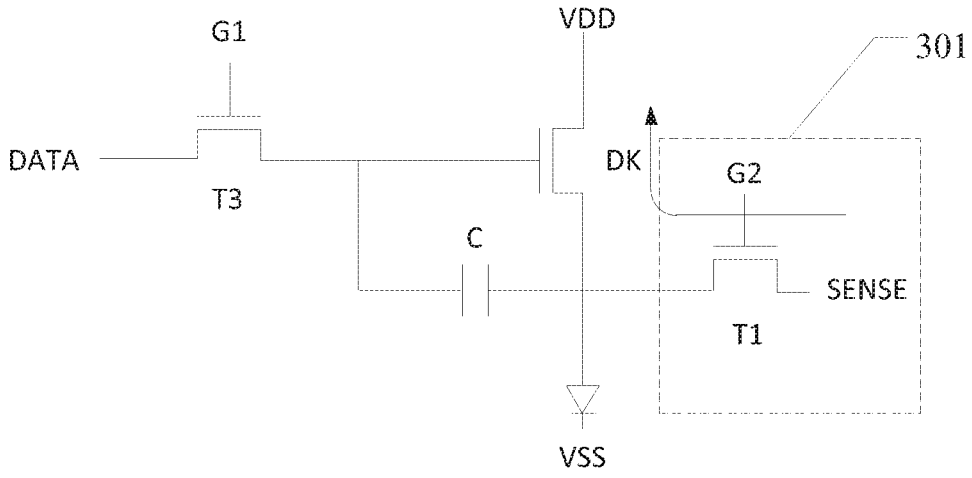
FIG. 5 is a schematic diagram of sensing a current signal flowing through a drive transistor according to an exemplary embodiment of the present disclosure.

In the Manner II, as shown in FIG. 5, the current signal flowing through the drive transistor DK may be sensed to acquire the electric signal of the first electrode of the electroluminescent element. In this example embodiment, the current signal flowing through the drive transistor DK may be sensed, and the electric signal of the first electrode of the electroluminescent element may be calculated based on the current signal.

It is to be noted that the external electrical compensation sub-circuit 301 is only one of the external electrical compensation sub-circuits in the present disclosure, which is exemplary and explanatory only, and is not intended to limit the present disclosure.

In Step S120, in the light emitting phase of the pixel driving circuit, a brightness signal of the electroluminescent element is sensed by a photosensitive sensor and an optical compensation signal is calculated according to the brightness signal.

Figure 6:
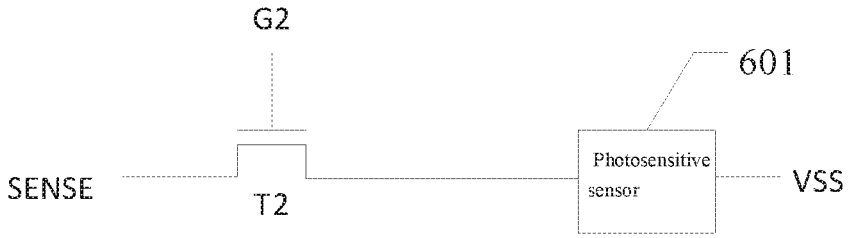
FIG. 6 is a schematic diagram of an external optical compensation sub-circuit according to an exemplary embodiment of the present disclosure.

In this example embodiment, the photosensitive sensor may be, for example, a photosensitive diode, which may include a PN junction photosensitive diode, a PIN-junction photosensitive diode, an avalanche-type photosensitive diode, and a Schottky-junction photosensitive diode. The photosensitive sensor may be arranged in a light path of the electroluminescent element. The connection mode of the photosensitive sensor is as shown in FIG. 6. One electrode of the photosensitive sensor 601 is connected to the sense line SENSE through a second switch element T2, and the other electrode of the photosensitive sensor 601 receives a second power signal VSS. The control terminal of the second switch element T2 receives a scanning signal G2. The second switch element T2 may be an N-type transistor or a P-type transistor.

It is to be noted that the second switch element T2 here may be removed, i.e., one terminal of the photosensitive sensor 601 is directly connected to the sense line SENSE. Compared with the removal of the second switch element T2, reserving the second switch element T2 allows the photosensitive sensor to transmit the brightness signal to the sense line SENSE only in the light emitting phase of the pixel driving circuit, such that the calculated data are reduced and the operating efficiency is improved.

In the light emitting phase of the pixel driving circuit, the first scanning signal G1 is a low level, the scanning signal G2 is a high level, the third switch element T3 is disabled, the second switch element T2 is enabled, the control terminal of the drive transistor DK is enabled under the action of the capacitor C, and a drive current is output under the action of the first power signal VDD to drive the electroluminescent element to emit light. Meanwhile, the photosensitive sensor 601 senses a brightness signal of the electroluminescent element, i.e., the photosensitive sensor 601 converts a brightness value of the electroluminescent element into a brightness signal and transmits the brightness signal to the sense line SENSE through the second switch element T2. The sense line SENSE transmits the brightness signal to a processor, such that the processor calculates an optical compensation signal according to the brightness signal.

It is to be noted that the connection mode of the photosensitive sensor 601 is an example and explanatory only and is not intended to limit the present disclosure.

In Step S130, a comprehensive compensation signal is generated according to the electrical compensation signal and the optical compensation signal, and a signal on a control terminal of the drive transistor is controlled according to the comprehensive compensation signal.

In this exemplary embodiment, a comprehensive compensation signal may be generated using the processor according to the electrical compensation signal and the optical compensation signal, and the comprehensive compensation signal is transmitted to the control terminal of the drive transistor DK through the data line DATA to compensate the electroluminescent element, such that the uniformity of the light emission brightness of each pixel is implemented. It is to be noted that the processor may be a module of a drive IC.

In conclusion, a brightness signal of an electroluminescent element is sensed by a photosensitive sensor, i.e., a brightness value of the electroluminescent element is converted into the brightness signal by the photosensitive sensor to compensate the electroluminescent element according to the brightness signal. Compared with the related art, there is provided a new external optical compensation method, which is large in compensation range, high in compensation precision, and fast in drive speed, and may compensate the electroluminescent element in real time. Furthermore, an electric signal of a first electrode of the electroluminescent element and a brightness signal of the electroluminescent element are sensed, and then the electroluminescent element is compensated according to the electric signal and the brightness signal, i.e., the electroluminescent element is compensated in combination with external electrical compensation and external optical compensation. The method is large in compensation range, high in compensation precision, and fast in drive speed, and may compensate the electroluminescent element in real time. In this regard, display unevenness caused by differences in the threshold voltage and the mobility of a drive transistor and the drive voltage of the electroluminescent element and the like may be compensated, the uniformity of the display brightness of each pixel is ensured, and the occurrence of residual images such as regional spots or regional images is avoided.

This example embodiment also provides a pixel compensation circuit, which is configured to provide a comprehensive compensation signal to a pixel driving circuit. The pixel driving circuit may include a drive transistor connected to a first electrode of an electroluminescent element. For example, FIG. 2 illustrates a schematic diagram of a pixel driving circuit having a 2T1C structure. The pixel driving circuit may include: a drive transistor DK connected to a first electrode of an electroluminescent element, a capacitor C, and a third switch element T3. A control terminal of the drive transistor DK is connected to a data line DATA through the third switch element T3. A first terminal of the drive transistor DK receives a first power signal VDD, a second terminal of the drive transistor DK is connected to the first electrode of the electroluminescent element, and a second electrode of the electroluminescent element receives a second power signal VSS. A control terminal of the third switch element T3 receives a first scanning signal G1. The capacitor C is connected between the control terminal and the second terminal of the drive transistor DK. The data line DATA is configured to provide a data signal to the control terminal of the drive transistor DK. The first electrode of the electroluminescent element may be an anode, and the second electrode of the electroluminescent element may be a cathode. Alternatively, the first electrode of the electroluminescent element may be the cathode, and the second electrode of the electroluminescent element may be the anode.

It is to be noted that, in the pixel driving circuit having the 2T1C structure as shown in FIG. 2, the third switch element T3 may be a P-type transistor or an N-type transistor, and all the transistors may be enhancement type transistors or depletion type transistors, which is not particularly limited herein. The control terminal of the third switch element T3 may be a gate, the first terminal thereof may be a source, and the second terminal thereof may be a drain. Alternatively, the control terminal of the third switch element T3 may be a gate, the first terminal thereof may be a drain, and the second terminal thereof may be a source. In addition, the pixel driving circuit having the 2T1C structure as shown in FIG. 2 is an example and explanatory only and is not intended to limit the present disclosure. The pixel driving circuit in the present disclosure also may be a pixel driving circuit having other structures.

The pixel compensation circuit may include an external electrical compensation sub-circuit, an external optical compensation sub-circuit, and a processor.

The external electrical compensation sub-circuit may be configured to sense, in a light emitting phase of the pixel driving circuit, an electric signal of the first electrode of the electroluminescent element. For example, as shown in FIG. 3, the external electrical compensation sub-circuit 301 may include a first switch element T1 and a sense line SENSE.

The first switch element T1 is connected to the first electrode of the electroluminescent element and is configured to be enabled in response to a scanning signal G2 to communicate the first electrode of the electroluminescent element with the sense line SENSE. Specifically, the first switch element T1 includes a first terminal, a second terminal, and a control terminal. The control terminal of the first switch element T1 receives the scanning signal G2, the first terminal of the first switch element T1 is connected to the first electrode of the electroluminescent element, and the second terminal of the first switch element T1 is connected to the sense line SENSE. It is to be noted that the first switch element T1 may be a P-type transistor or an N-type transistor, which is not particularly limited by this example embodiment. The control terminal of the first switch element T1 may be a gate, the first terminal thereof may be a source, and the second terminal thereof may be a drain. Alternatively, the control terminal of the first switch element T1 may be a gate, the first terminal thereof may be a drain, and the second terminal thereof may be a source, which is not particularly limited by this exemplary embodiment.

The sense line SENSE is connected to the first switch element T1 and is configured to sense, by the first switch element T1, an electric signal of the first electrode of the electroluminescent element, and transmit the electric signal to the processor. The processor may be a module of a drive IC.

It is to be noted that the structure of the external electrical compensation sub-circuit 3 as shown in FIG. 3 is an example and not intended to limit the present disclosure. FIG. 3 illustrates a schematic diagram of connecting the external electrical compensation sub-circuit 301 on the basis of the pixel driving circuit in FIG. 2. The mode of connecting an external electrical compensation sub-circuit on the basis of a pixel driving circuit having other structures is still to connect the external electrical compensation sub-circuit 301 to the first electrode of the electroluminescent element connected to the pixel driving circuit.

The sensing an electric signal of the first electrode of the electroluminescent element may include two manners as below.

In Manner I, as shown in FIG. 4, a current signal flowing through the electroluminescent element may be sensed to acquire the electric signal of the first electrode of the electroluminescent element. In this example embodiment, the current signal flowing through the electroluminescent element may be sensed, and the electric signal of the first electrode of the electroluminescent element may be calculated based on the current signal.

In Manner II, as shown in FIG. 5, the current signal flowing through the drive transistor DK may be sensed to acquire the electric signal of the first electrode of the electroluminescent element. In this exemplary embodiment, the current signal flowing through the drive transistor DK may be sensed, and the electric signal of the first electrode of the electroluminescent element may be calculated based on the current signal.

The external optical compensation sub-circuit may be configured to sense, in the light emitting phase of the pixel driving circuit, a brightness signal of the electroluminescent element by a photosensitive sensor in the external optical compensation sub-circuit. As shown in FIG. 6, the external optical compensation sub-circuit 302 may include a photosensitive sensor 601 and a second switch element T2.

The photosensitive sensor 601 may be configured to sense, in the light emitting phase of the pixel driving circuit, a brightness signal of the electroluminescent element. That is, a brightness value of the electroluminescent element is converted into the brightness signal.

The second switch element T2 is connected between the sense line SENSE and the photosensitive sensor 601, and is configured to be enabled in response to a scanning signal G2, such that the brightness signal sensed by the photosensitive sensor 601 is transmitted to the processor through the sense line SENSE. The second switch element T2 includes a control terminal, a first terminal, and a second terminal. Specifically, the control terminal of the second switch element T2 receives the scanning signal G2, the first terminal of the second switch element T2 is connected to the sense line SENSE, and the second terminal of the second switch element T2 is connected to the photosensitive sensor 601. It is to be noted that the second switch element T1 may be a P-type transistor or an N-type transistor, which is not particularly limited by this exemplary embodiment. The control terminal of the second switch element T2 may be a gate, the first terminal thereof may be a source, and the second terminal thereof may be a drain. Alternatively, the control terminal of the second switch element T2 may be a gate, the first terminal thereof may be a drain, and the second terminal thereof may be a source, which is not particularly limited by this exemplary embodiment.

The processor may be configured to calculate an electrical compensation signal according to the electric signal, calculate an optical compensation signal according to the brightness signal, generate a compensative compensation signal according to the electrical compensation signal and the optical compensation signal, and control a signal on a control terminal of the drive transistor according to the comprehensive compensation signal.

In conclusion, an external optical compensation sub-circuit senses a brightness signal of an electroluminescent element by a photosensitive sensor, i.e., a brightness value of the electroluminescent element is converted into the brightness signal by the photosensitive sensor to compensate the electroluminescent element according to the brightness signal. Compared with the related art, a new external optical compensation method is provided, which is large in compensation range, high in compensation precision, and fast in drive speed, and may compensate the electroluminescent element in real time. Furthermore, an external electrical compensation sub-circuit senses an electric signal of a first electrode of the electroluminescent element, and the external optical compensation sub-circuit senses a brightness signal of the electroluminescent element using the photosensitive sensor, and then a processor compensates the electroluminescent element according to the electric signal and the brightness signal, i.e., the electroluminescent element is compensated in combination with external electrical compensation and external optical compensation. The method is large in compensation range, high in compensation precision, and fast in drive speed, and may compensate the electroluminescent element in real time. In this regard, display unevenness caused by differences in the threshold voltage and the mobility of a drive transistor and the drive voltage of the electroluminescent element and the like may be compensated, the uniformity of the display brightness of each pixel is ensured, and the occurrence of residual images such as regional spots or regional images is avoided.

This example embodiment further provides a display device, which includes the above pixel compensation circuit. The display device may allow the display brightness of the electroluminescent element in each pixel to remain consistent, and prevent from generating residual images such as regional spots and regional images, etc., and thus may improve the display quality. In this example embodiment, the display device may be any product or component having a display function, such as a mobile phone, a tablet computer, a TV set, a notebook computer, a digital photo frame, a navigation device, and so forth.

Figure 7:
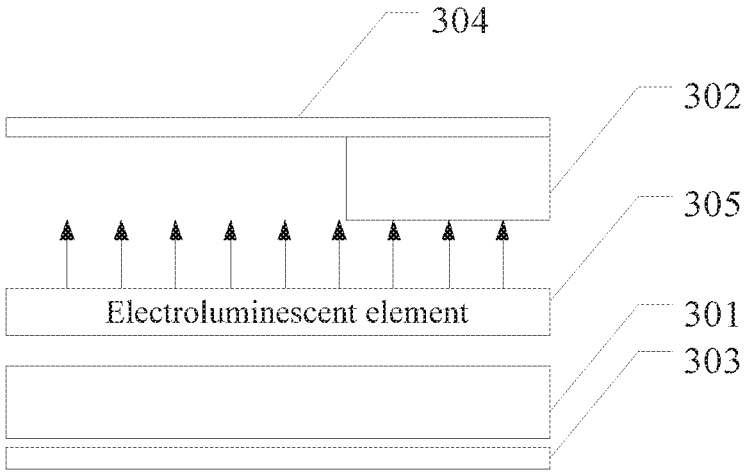
FIG. 7 is a schematic structural diagram of a display device according to the present disclosure.

On this basis, the pixel compensation circuit may include an external electrical compensation sub-circuit and an external optical compensation sub-circuit. As shown in FIG. 7, the external electrical compensation sub-circuit 301 is arranged on a substrate 303 of the display device. The external optical compensation sub-circuit 302 is arranged on a cover plate 304 of the display device, and a photosensitive sensor in the external optical compensation sub-circuit 302 directly faces an electroluminescent element 305 in the display device.

An example embodiment of the present disclosure provides a pixel compensation circuit, a method for compensating a pixel driving circuit, and a display device. The method for compensating the pixel driving circuit may include: in a light emitting phase of the pixel driving circuit, sensing an electric signal of a first electrode of an electroluminescent element, and calculating an electrical compensation signal based on the electric signal; sensing a brightness signal of the electroluminescent element by a photosensitive sensor, and calculating an optical compensation signal according to the brightness signal; and finally generating a comprehensive compensation signal according to the electrical compensation signal and the optical compensation signal, to control a signal on a control terminal of a drive transistor according to the comprehensive compensation signal. In one aspect, a brightness signal of an electroluminescent element is sensed by a photosensitive sensor, i.e., a brightness value of the electroluminescent element is converted into the brightness signal by the photosensitive sensor to compensate the electroluminescent element according to the brightness signal. Compared with the related art, a new external optical compensation method is provided, which is large in compensation range, high in compensation precision, and fast in drive speed, and may compensate the electroluminescent element in real time. In another aspect, an electric signal of a first electrode of the electroluminescent element and a brightness signal of the electroluminescent element are sensed, and then the electroluminescent element is compensated according to the electric signal and the brightness signal, i.e., the electroluminescent element is compensated in combination with external electrical compensation and external optical compensation. The method is large in compensation range, high in compensation precision, and fast in drive speed, and may compensate the electroluminescent element in real time. In this regard, display unevenness caused by differences in the threshold voltage and the mobility of a drive transistor and the drive voltage of the electroluminescent element and the like may be compensated, the uniformity of the display brightness of each pixel is ensured, and the occurrence of residual images such as regional spots or regional images is avoided.

It is to be noted that, although a plurality of modules or units of the device for action execution have been mentioned in the above detailed description, this partition is not compulsory. Actually, according to the embodiment of the present disclosure, features and functions of two or more modules or units as described above may be embodied in one module or unit. Reversely, features and functions of one module or unit as described above may be further embodied in more modules or units.

In addition, steps of the method in the present disclosure are described in a particular order in the accompanying drawings. However, this does not require or imply to execute these steps necessarily according to the particular order, or this does not mean that the expected result cannot be implemented unless all the shown steps are executed. Additionally or alternatively, some steps may be omitted, a plurality of steps may be combined into one step for execution, and/or one step may be decomposed into a plurality of steps for execution.

Other embodiments of the present disclosure will be apparent to those skilled in the art from consideration of the specification and practice of the content disclosed here. This application is intended to cover any variations, uses, or adaptations of the present disclosure following the general principles thereof and including such departures from the present disclosure as come within known or customary practice in the art. It is intended that the specification and embodiments be considered as exemplary only, with a true scope and spirit of the present disclosure being indicated by the appended claims.

What is claimed is:

1. A method for compensating a pixel driving circuit, comprising:

providing the pixel driving circuit, the pixel driving circuit comprising a drive transistor connected to a first electrode of an electroluminescent element, a capacitor, a third switch element, an external electrical compensation sub-circuit comprising a first switch element and a sense line, an external optical compensation sub-circuit comprising a photosensitive sensor, and a second switch element, wherein a gate of the first switch element is connected to a gate of the second switch element, the photosensitive sensor is connected to a second power signal, and the sense line is connected to the second switch element;

in a light emitting phase of the pixel driving circuit, disabling the third switch element, enabling the second switch element, enabling the control terminal of the drive transistor under action of the capacitor, outputting a drive current to drive the electroluminescent element to emit light, and, meanwhile, the sense line sensing, by the first switch element, an electric signal of the first electrode of the electroluminescent element, and calculating an electrical compensation signal based on the electric signal;

in the light emitting phase of the pixel driving circuit, disabling the third switch element, enabling the second switch element, enabling the control terminal of the drive transistor under action of the capacitor, and outputting a drive current to drive the electroluminescent element to emit light, and, meanwhile, a photosensitive sensor sensing a brightness signal of the electroluminescent element and transmitting the brightness signal to the sense line through the second switch element, and calculating an optical compensation signal according to the brightness signal; and generating a comprehensive compensation signal according to the electrical compensation signal and the optical compensation signal, and controlling a signal on a control terminal of the drive transistor according to the comprehensive compensation signal.

2. The method for compensating the pixel driving circuit according to claim 1, wherein the sensing an electric signal of the first electrode of the electroluminescent element comprises: sensing a current signal flowing through the electroluminescent element to acquire the electric signal of the first electrode of the electroluminescent element.

3. The method for compensating the pixel driving circuit according to claim 1, wherein the sensing an electric signal of the first electrode of the electroluminescent element comprises: sensing a current signal flowing through the drive transistor to acquire the electric signal of the first electrode of the electroluminescent element.

4. A pixel compensation circuit configured to provide a comprehensive compensation signal to a pixel driving circuit, the pixel driving circuit comprising a drive transistor connected to a first electrode of an electroluminescent element, and the pixel compensation circuit comprising:

an external electrical compensation sub-circuit comprising a first switch element and a sense line, and configured to sense, in a light emitting phase of the pixel driving circuit, an electric signal of the first electrode of the electroluminescent element at the same time as the electroluminescent element is driven to emit light;

an external optical compensation sub-circuit comprising a photosensitive sensor and a second switch element, and configured to sense, in the light emitting phase of the pixel driving circuit, a brightness signal of the electroluminescent element by a photosensitive sensor at the same time as the electroluminescent element is driven to emit light;

wherein a gate of the first switch element is connected to a gate of the second switch element, the photosensitive sensor is connected to a second power signal, and the sense line is connected to the second switch element; and a processor configured to:

calculate an electrical compensation signal according to the electric signal;

calculate an optical compensation signal according to the brightness signal;

generate a compensative compensation signal according to the electrical compensation signal and the optical compensation signal; and control a signal on a control terminal of the drive transistor according to the comprehensive compensation signal.

5. The pixel compensation circuit according to claim 4, wherein the sensing an electric signal of the first electrode of the electroluminescent element comprises: sensing a current signal flowing through the electroluminescent element to acquire the electric signal of the first electrode of the electroluminescent element.

6. The pixel compensation circuit according to claim 4, wherein the sensing an electric signal of the first electrode of the electroluminescent element comprises: sensing a current signal flowing through the drive transistor to acquire the electric signal of the first electrode of the electroluminescent element.

7. The pixel compensation circuit according to claim 4, wherein:

the first switch element is connected to the first electrode of the electroluminescent element and is configured to be enabled in response to a scanning signal to communicate the first electrode of the electroluminescent element with the sense line; and the sense line is connected to the first switch element and is configured to sense, by the first switch element, an electric signal of the first electrode of the electroluminescent element, and transmit the electric signal to the processor.

8. The pixel compensation circuit according to claim 7, wherein:

the first switch element comprises a first terminal, a second terminal, and a control terminal; and the control terminal receives the scanning signal, the first terminal is connected to the first electrode of the electroluminescent element, and the second terminal is connected to the sense line.

9. The pixel compensation circuit according to claim 4, wherein:

the photosensitive sensor is configured to sense, in the light emitting phase of the pixel driving circuit, a brightness signal of the electroluminescent element; and the second switch element is connected between the sense line and the photosensitive sensor, and is configured to be enabled in response to a scanning signal, such that the brightness signal sensed by the photosensitive sensor is transmitted to the processor through the sense line.

10. The pixel compensation circuit according to claim 9, wherein the second switch element comprises a control terminal, a first terminal, and a second terminal, wherein: the control terminal receives the scanning signal, the first terminal is connected to the sense line, and the second terminal is connected to the photosensitive sensor.

11. A display device, comprising the pixel compensation circuit according to claim 4.

12. The display device according to claim 11, further comprising a substrate, wherein the pixel compensation circuit comprises an external electrical compensation sub-circuit and an external optical compensation sub-circuit;

the external electrical compensation sub-circuit is arranged on the substrate of the display device;

the external optical compensation sub-circuit is arranged at a light exit side of the electroluminescent element; and a photosensitive sensor in the external optical compensation sub-circuit directly faces the electroluminescent element in the display device.

13. The display device according to claim 12, wherein the processor is integrated into a drive integrated circuit of the display device.

14. The display device according to claim 11, wherein the sensing an electric signal of the first electrode of the electroluminescent element comprises:

sensing a current signal flowing through the electroluminescent element to acquire the electric signal of the first electrode of the electroluminescent element.

15. The display device according to claim 11, wherein the sensing an electric signal of the first electrode of the electroluminescent element comprises: sensing a current signal flowing through the drive transistor to acquire the electric signal of the first electrode of the electroluminescent element.

16. The display device according to claim 11, wherein:

the external electrical compensation sub-circuit comprises a first switch element and a sense line;

the first switch element is connected to the first electrode of the electroluminescent element and is configured to be enabled in response to a scanning signal to communicate the first electrode of the electroluminescent element with the sense line; and the sense line is connected to the first switch element and is configured to sense, by the first switch element, an electric signal of the first electrode of the electroluminescent element, and transmit the electric signal to the processor.

17. The display device according to claim 16, wherein:

the first switch element comprises a first terminal, a second terminal, and a control terminal; and the control terminal receives the scanning signal, the first terminal is connected to the first electrode of the electroluminescent element, and the second terminal is connected to the sense line.

18. The display device according to claim 11, wherein:

the external optical compensation sub-circuit comprises the photosensitive sensor and a second switch element;

the photosensitive sensor is configured to sense, in the light emitting phase of the pixel driving circuit, a brightness signal of the electroluminescent element; and the second switch element is connected between the sense line and the photosensitive sensor, and is configured to be enabled in response to a scanning signal, such that the brightness signal sensed by the photosensitive sensor is transmitted to the processor through the sense line.

19. The display device according to claim 18, wherein the second switch element comprises a control terminal, a first terminal, and a second terminal, wherein the control terminal receives the scanning signal, the first terminal is connected to the sense line, and the second terminal is connected to the photosensitive sensor.

20. The display device according to claim 12, wherein the sensing an electric signal of the first electrode of the electroluminescent element comprises: sensing a current signal flowing through the electroluminescent element to acquire the electric signal of the first electrode of the electroluminescent element.

* * * * *